United States Patent [19]

Nakada et al.

[11] 4,365,600

[45] Dec. 28, 1982

[54] DIESEL THROTTLE VALVE CONTROL SYSTEM

[75] Inventors: Teruo Nakada, Yokohama; Mitsuo Iwahara, Ebina, both of Japan

[73] Assignee: Isuzu Motors, Limited, Kanagawa, Japan

[21] Appl. No.: 174,424

[22] Filed: Aug. 1, 1980

[51] Int. Cl.[3] ..... F02D 1/04; F02D 1/06

[52] U.S. Cl. ..... 123/339; 123/336; 123/382

[58] Field of Search ..... 123/339, 336, 382, 383

[56] References Cited

U.S. PATENT DOCUMENTS

| | | | |
|---|---|---|---|
| 2,398,878 | 4/1946 | Bolli | 123/382 |
| 2,904,025 | 9/1959 | Scherenberg | 123/336 |
| 3,169,513 | 2/1965 | Hennequin | 123/382 |
| 4,058,101 | 11/1977 | Taira | 123/382 |

*Primary Examiner*—Ronald B. Cox

*Attorney, Agent, or Firm*—Sughrue, Mion, Zinn, Macpeak and Seas

[57] ABSTRACT

An intake air throttle valve control system for a diesel engine which greatly reduces vibration, noise and rough engine running at idling speeds. An intake passage connected in series with the intake manifold of the engine is divided into first and second parallel intake passages. A throttle valve is disposed in a first intake passage to provide a throttling effect therein in response to predetermined engine conditions such as engine temperature, oil line pressure and/or exhaust manifold pressure. A negative pressure control valve is disposed in the second passage to maintain a negative pressure downstream of first and second passages at a fixed value to prevent the pressure from being overly reduced by the throttle valve.

7 Claims, 3 Drawing Figures

DIESEL THROTTLE VALVE CONTROL SYSTEM

BACKGROUND OF THE INVENTION

The present invention relates to a pneumatic air intake throttle valve control device for a diesel engine for pneumatically controlling an intake throttle valve therein operated at engine idle speed.

Recently, diesel engine vehicles, particularly passenger cars, have become more popular due to their economic advantages. However, vibration and noise produced by diesel engines have been problematic. Particularly, the engine idle speed torque fluctuations, that is, angular velocity fluctuation during a single engine cycle, have been remarkably high in comparison with gasoline engines. This is one factor causing the large amounts of noise and vibration.

In view of the above noted defects, an object of the present invention is to provide an intake air throttle valve control device in which at idle speed or for no-load operation of the engine the air intake is controlled while at the same time the amount of throttle opening is controlled in accordance with exhaust pressure, engine water temperature, intake pressure and the like.

SUMMARY OF THE INVENTION

In accordance with this and other objects of the invention, there is provided an intake air throttle valve control system for a diesel engine having an intake manifold and an exhaust manifold including an intake passage connected to the intake manifold with the intake passage being partitioned by divider into first and second parallel intake passages. A throttle valve is disposed in a first intake passage which provides a throttling effect depending upon the angular position thereof. A negative pressure control valve is disposed in the second passage for maintaining a negative pressure downstream of the first and second passages at a predetermined substantially constant value when the engine is operating at idle speed. The system preferably further includes a source of negative pressure, a first pressure responsive actuator coupled to the throttle valve with the first actuator having an atmospheric pressure chamber, a negative pressure chamber and a diaphragm separating the atmospheric pressure chamber from the negative pressure chamber and a spring biasing the diaphragm towards the negative pressure chamber. An engine temperature sensing valve having inlet and outlet ports is operatively positioned to operate in response to the temperature of the engine. The outlet port of the water temperature sensing valve is in fluid communication with the negative pressure chamber of the actuator. A vacuum cut-off valve having inlet and outlet ports with the outlet port of the vacuum cut-off valve in fluid communication with the inlet port of the engine temperature sensing valve vents the inlet port thereof to the atmosphere in response to a predetermined engine operational parameter. A second pressure responsive actuator operates the control valve. The second actuator has an atmospheric pressure chamber and a negative pressure chamber separated by a diaphragm with spring means biasing the diaphragm towards the atmospheric pressure chamber. The negative pressure chamber of the second actuator communicates with a portion of the intake passage downstream of the first and second intake passages.

Yet further, the vacuum cut-off valve has a negative pressure chamber, an atmospheric pressure chamber and a pressure chamber which is in fluid communication with the exhaust manifold. A diaphragm dividing the atmospheric pressure chamber from the pressure chamber which is in fluid communication with the exhaust manifold is coupled to a rod which moves a valve body disposed in the negative pressure chamber. A partitioning plate divides the atmospheric pressure chamber from the negative pressure chamber. A spring biases the diaphragm away from the partitioning plate. The valve body operates to open and block a connecting tube to the negative pressure source. The vacuum cut-off valve may operate in response to the pressure in an oil line of the engine. The vacuum cut-off valve, in a preferred embodiment, includes a three-way electromagnetic valve having an inlet port, an outlet port and atmospheric venting port along with means for operating the three-way electromagnetic valve in response to the predetermined engine parameter. The means for operating the three-way electromagnetic valve may include an electrical switch connected to be operated in response to the pressure in an oil line of the engine. The operating means may also be an electrical generator which operatively coupled to the engine with the electrical generator producing an output voltage which varies in response to the speed of rotation of the engine.

DESCRIPTION OF THE PREFERRED EMBODIMENTS

Figure 1:
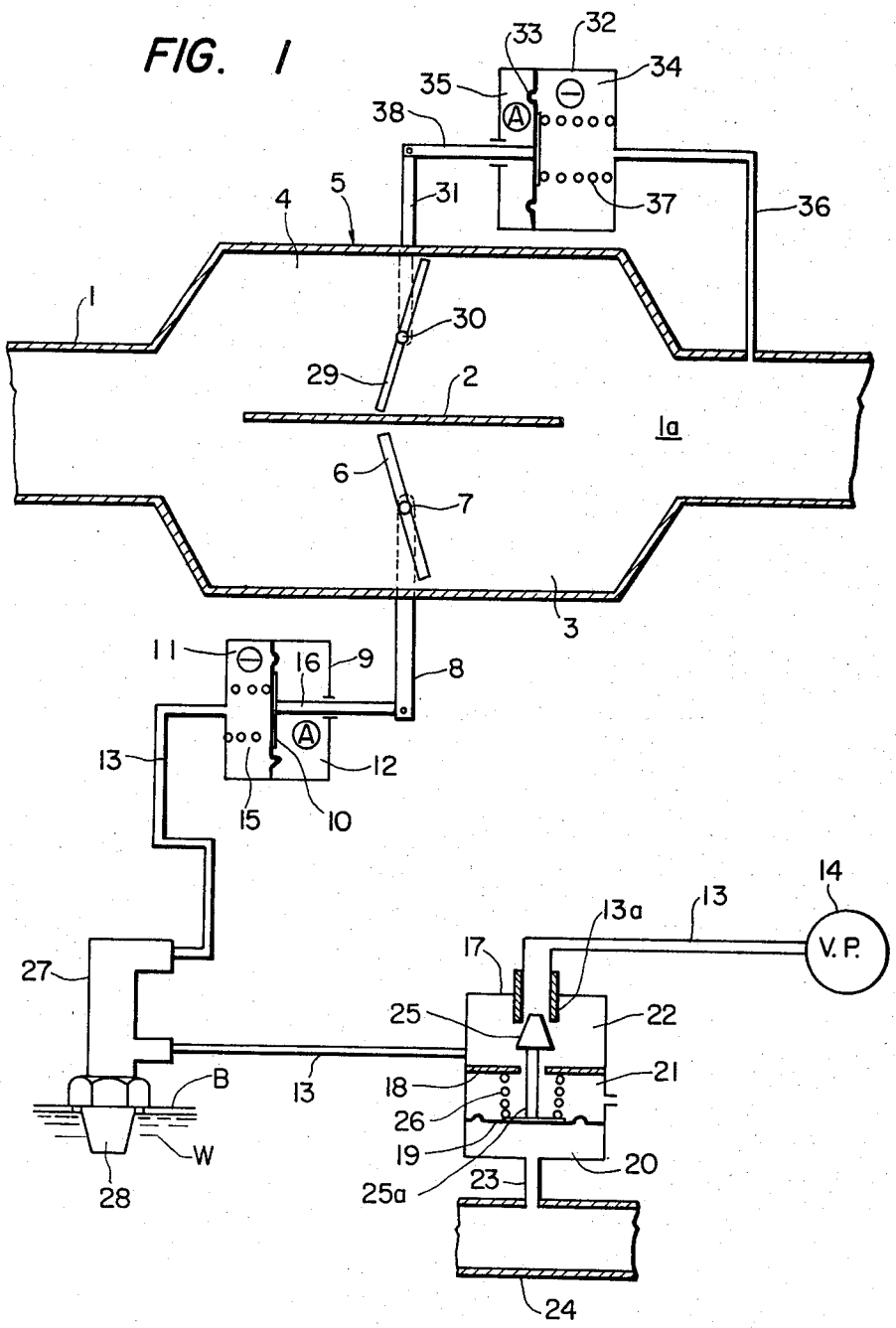
FIG. 1 is a diagram, partially as a cross-sectional view, of an intake air throttle valve control system constructed in accordance with a first embodiment of the invention.

A diesel engine system constructed according to the present invention will now be described with reference to FIG. 1. Reference numeral 1 designates an intake passage of a diesel engine which includes an intake air throttling portion 5 which is divided into first and second passages 3 and 4 by a partitioning wall 2. In the first passage 3, an intake air throttle valve 6 is rotatably supported by a peripheral wall of the passage by a shaft 7. An arm 8 is coupled to one end of the shaft 7 for rotating the throttle valve 6. The construction and operation of the valve and shaft are well known in the art.

Reference numeral 9 denotes a negative pressure responsive actuator which is separated into a negative pressure chamber 11 and an atmospheric pressure chamber 12 which is vented to the atmosphere through a suitable hole (not shown). The negative pressure chamber 11 communicates with a vacuum pump 14 through a suitable tube 13 and includes therein a return spring 15 which presses upon a diaphragm 10. One end of a rod 16 extends into the atmospheric pressure chamber 12 and is coupled to the diaphragm 10 while the other end of the rod 16 extends outwardly and is connected directly or through a suitable linkage to the arm 8.

A vacuum cut-off valve 17 is coupled in series with actuator 9 through the tube 13. The vacuum cut-off valve is divided into a pressure chamber 20, an atmospheric pressure chamber 21 and a negative chamber 22 by a partitioning plate 18 and a diaphragm 19, respectively. The pressure pressure chamber 20 communicates with an exhaust passage 24 of the engine through a tube 23 so as to detect the exhaust pressure in the exhaust passage 24. A valve body 25 is coupled via a valve stem 25*a* to the diaphragm 19 so that when a predetermined exhaust pressure acts on the diaphragm 19 the valve body 25 is operated to close an opening 13*a* in series with the tube 13 against a return spring 26.

A water temperature detecting valve 27 is disposed between the vacuum cut-off valve 17 and the actuator 9. A water temperature detecting element 28 is mounted on a cylinder body B and disposed in a water jacket W of the engine. The water temperature detecting valve 27 is operated to open or close an inner passage (not shown) therethrough in response to the water temperature detecting element.

An intake air negative pressure control valve 29 operatively mounted in the second passage 4 is rotatably supported by a shaft 30 by a wall of the intake air throttle portion 5. An arm 31 is coupled to the other end of the shaft 30 to operate the control valve 29.

An actuator 32 has a negative pressure chamber 34 and an atmospheric pressure chamber 35 separated by a diaphragm 33. The negative pressure chamber 34 communicates through a tube 36 with a portion 1*a* of the air intake passage 1 downstream of the intake air throttle portion 5 so as to detect the intake negative pressure at the portion 1*a*. A spring 37 is disposed in the negative pressure chamber 34 to bias the diaphragm 33 leftward in FIG. 1, that is, in the direction to close the control valve 29. The atmospheric pressure chamber 35 is vented to the atmosphere through a suitable hole (not shown). One end of a rod 38 extends into the atmospheric pressure chamber 35 and is connected to the diaphragm 33 while the other end of the rod 38 is connected to the above described arm 31 directly or through a suitable linkage.

The operation of the thus constructed system according to the present invention will now be described. When the engine is operating at idle speed at a normal temperature, the exhaust pressure in the exhaust passage 24 is low and the water temperature detecting valve is opened so that the diaphragm 10 and the rod 16 are positioned to the left acting against the return spring 15 by action of the vacuum pump. As a result, the intake air throttle valve 6 is rotated clockwise to thereby throttle the intake air flow. Accordingly, the flow rate of intake air is decreased so that the rate of rotation and vibromotive acceleration of the engine are reduced advantageously.

However, if the throttling effect of the intake air throttle valve 6 is further increased and as a result the intake air negative pressure in the portion 1*a* downstream of the intake air throttle portion 5 excessively increased, an increased negative pressure is also applied to the negative pressure chamber 34 of the actuator 32 in proportion to the magnitude of the intake air negative pressure in the portion 1*a*. Therefore, the diaphragm 33 and the rod 38 are moved to the right against the force of the return spring 37 so that the control valve 29 is rotated clockwise by the arm 31 to thereby increase its opening angle. As a result, excessive increases in the negative pressure in the downstream portion 1*a* are prevented.

When the engine temperature is sufficiently low, just after starting the engine and when the engine is running at idle speed, although the vacuum cut-off valve 17 is open, the inner passage of the water temperature detecting valve 27 is closed until the detecting element 28 reaches a predetermined temperature. Accordingly, the actuator 9 is then inoperative and the intake air throttle valve 6 is maintained in the fully open state to thereby avoid degrading the engine start performance.

Moreover, irrespective of the temperature, when the engine is running at speeds other than idle speed, the exhaust pressure in the exhaust passage 24 is increased and a high pressure is applied to the pressure chamber 20 so that the diaphragm 19 and the valve body 25 are moved against the return spring 26 upwardly to thereby close the opening 13*a*. As a result, the actuator 9 is rendered inoperative to hence return the intake air throttle valve 6 to the open position and to remove any throttling effect in the intake air throttle portion 5.

Therefore, according to the present invention, at normal engine speeds except idle speed, no engine performance degradation such as output power reduction is caused by the presence of the valves 6 and 29. As vibration is reduced at the idle speed of the engine as mentioned above, chassis vibration and a gear shift lever vibration are effectively reduced with the use of the invention.

Figure 2:
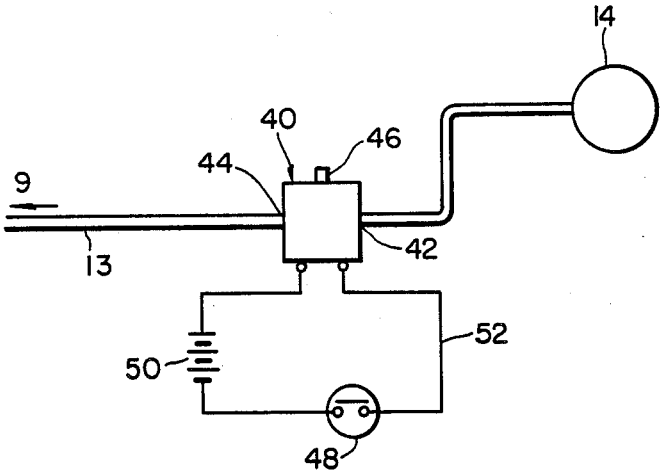
FIG. 2 is a diagram showing an alternative embodiment of a vacuum cut-off valve utilized in the system shown in FIG. 1.

FIG. 2 shows another embodiment of the present invention is which a three-way electromagnetic valve 40 is employed instead of the cut-off valve 17 shown in FIG. 1. The three-way electromagnet valve 40 is provided with a negative pressure inlet port 42, a negative pressure outlet port 44 and a vent hole 46 to the atmosphere and is so constructed that the outlet port 44 can be selectively communicated with the inlet port 42 or the vent hole 46. A pressure detecting switch 48 such as a hydraulic pressure detecting switch for detecting the hydraulic pressure in the engine oil lines is employed to operate the electromagnetic valve 40. In FIG. 2, the detecting switch 48 is constructed so that when the hydraulic pressure is low, for example, at engine idle speed, the contact points of the switch are open while when the engine speed is increased with an accompanying hydraulic pressure increase above a predetermined value, the contact points are closed to thereby operate the above described electromagnetic valve 40 by causing electric current from a battery 50 to flow through a circuit 52. The other elements of the system of FIG. 2 are the same as in the embodiment of FIG. 1.

In operation, the hydraulic pressure in the engine oil lines is low at engine idle speed. Accordingly, it will be understood that substantially the same effect as in the embodiment of FIG. 1 is obtained in the system partially shown in FIG. 2. That is, a negative pressure produced at the vacuum pump 14 is supplied through the inlet and outlet ports 42 and 44 at the engine idle speed to the negative pressure chamber 11 of the actuator 9 while when the engine speed is increased and the hydraulic pressure increased above the predetermined value, communication between the negative pressure inlet and outlet ports 42 and 44 is blocked and the outlet port is shunted to the atmosphere through the vent hole 46 by the action of the electromagnetic valve 40 to thereby render the actuator inoperative and to remove the throttling effect in the first passage 3.

Figure 3:
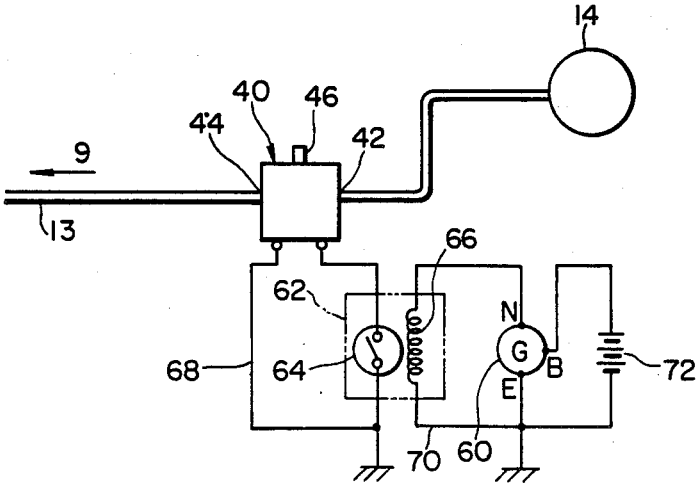
FIG. 3 is a diagram showing a further alternative embodiment of the vacuum cut-off valve of the system shown in FIG. 1.

FIG. 3 shows a still another embodiment of a control system according to the present invention in which an engine generator and associated components are utilized for controlling the system. A three-way electromagnetic valve 40 having an inlet port 42, an outlet port 44 and a vent hole 46 of the type shown in FIG. 2 is also utilized in the system of FIG. 3. A relay 62 is connected in a circuit 68 which controls the electromagnetic valve 40. A contact point 64 of the relay 62 is closed when a coil 66 connected to an E terminal of a generator 60 driven by the engine is energized through a circuit 70. A battery 72 is connected to the generator 60 at B and E terminals as shown, respectively.

In operation, since at engine idle speed, the output voltage from the generator 60 is low, the relay coil 66 is inoperative so that the relay contact 64 remains in the open state. In this case, communication between the inlet and outlet ports 42 and 44 is maintained so that the negative pressure produced by the vacuum pump 14 is introduced into the negative pressure chamber 11 of the actuator 9 to thereby produce a throttling effect in the first passage 3 in the same manner described above. On the other hand, when the engine speed is increased above the engine idle speed, the output voltage from the generator 60 is increased thereby energizing the relay coil 66 and closing the contact point 64. Accordingly, communication between the inlet and outlet ports 42 and 44 is blocked and the outlet port vented to the atmosphere through the vent hole 46 to thereby render the actuator 9 inoperative.

What is claimed is:

1. An intake air throttle valve control system for a diesel engine having an intake manifold and an exhaust manifold comprising:

intake passage means connected to said intake manifold, said intake passage means being partitioned into a first intake passage and a second intake passage connected in parallel;

a throttle valve disposed in said first intake passage for providing a throttling effect therein;

a negative pressure control valve disposed in said second passage; and means connected to said negative pressure control valve and responsive to a negative pressure downstream of said first and second passages for maintaining a negative pressure downstream of said first and second passage at a predetermined substantially constant value when said engine is operating at idle speed.

2. An intake air throttle valve control system for a diesel engine having an intake manifold and an exhaust manifold further comprising:

an intake passage connected to said intake manifold, said intake passage being partitioned into a first intake passage and a second intake passage;

a throttle valve disposed in said first intake passage for providing a throttling effect therein;

a negative pressure control valve disposed in said second passage for maintaining a negative pressure downstream of the first and second passages at a predetermined substantially constant value when said engine is operating at idle speed;

a source of negative pressure;

a first pressure responsive actuator coupled to operate said throttle valve, said first actuator having an atmospheric pressure chamber and a negative pressure chamber, a diaphragm separating said atmospheric pressure chamber and said negative pressure chamber, and spring means biasing said diaphragm towards said atmospheric pressure chamber;

an engine temperature sensing valve having inlet and outlet ports, said engine temperature sensing valve being operatively positioned to operate in response to engine temperature, said outlet port of said engine temperature sensing valve being in fluid communication with said negative pressure chamber of said actuator;

a vacuum cut-off valve having inlet and outlet ports, said outlet port of said vacuum cut-off valve being in fluid communication with said inlet port of said engine temperature sensing valve, said vacuum cut-off valve venting said inlet port of said water temperature sensing valve to the atmosphere in response to a predetermined engine operational parameter; and a second pressure responsive actuator operating said control valve, said second actuator having an atmospheric pressure chamber and a negative pressure chamber, a diaphragm separating said atmospheric pressure chamber and said negative pressure chamber, and spring means biasing said diaphragm towards said atmospheric pressure chamber, said negative pressure chamber of the second actuator communicating with a portion of said intake passage downstream of the first and second intake passages.

3. The intake air throttle valve control system of claim 2 wherein said vacuum cut-off valve has a negative pressure chamber, an atmospheric pressure chamber and a pressure chamber in fluid communication with said exhaust mainfold, a diaphragm dividing said atmospheric pressure chamber from said pressure chamber in fluid communication with said exhaust manifold, a partitioning plate dividing said atmospheric pressure chamber from said negative pressure chamber, said partitioning plate having an aperture therethrough, a rod coupled to move with said diaphragm, a valve body disposed within said negative pressure chamber and operatively coupled to said rod, and a spring biasing said diaphragm away from said partitioning plate.

4. The intake air throttle valve control system of claim 2 wherein said vacuum cut-off valve operates in response to the pressure in an oil line of said engine.

5. The intake air throttle valve control system of claim 2 wherein said vacuum cut-off valve comprises a three-way electromagnetic valve having an inlet port, an outlet port and an atmospheric venting port and means for operating said three-way electromagnetic valve in response to said parameter.

6. The intake air throttle valve control system of claim 5 wherein said operating means comprises an electrical switch connected to be operated in response to the pressure in an oil line of said engine.

7. The intake air throttle valve control system of claim 5 wherein said operating means comprises an electrical generator operatively coupled to said engine, said electrical generator producing an output voltage which varies in response to the speed of rotation of said engine.

* * * * *